US005921128A

United States Patent [19]

Stinnertz et al.

[11] Patent Number: 5,921,128

[45] Date of Patent: Jul. 13, 1999

[54] METHOD AND APPARATUS FOR COLD ROLLING TUBES

[75] Inventors: Horst Stinnertz, Willich; Jürgen Schmidt, Kaarst, both of Germany

[73] Assignee: Mannesmann Aktiengesellschaft, Düsseldorf, Germany

[21] Appl. No.: 08/982,489

[22] Filed: Dec. 2, 1997

[30] Foreign Application Priority Data

Dec. 17, 1996 [DE] Germany ..... 196 54 489

[51] Int. Cl.[6] ..... B21D 7/02; B21C 1/00

[52] U.S. Cl. ..... 72/214; 72/274

[58] Field of Search ..... 72/214, 274, 278, 72/277, 283, 218, 219, 250, 251, 252

[56] References Cited

U.S. PATENT DOCUMENTS

| | | | |
|---|---|---|---|
| 3,668,916 | 6/1972 | Ledebur | 72/274 |
| 4,819,471 | 4/1989 | Cook | 72/214 |

FOREIGN PATENT DOCUMENTS

| | | |
|---|---|---|
| 0 645 200 A1 | 3/1995 | European Pat. Off. . |
| 843 535 | 5/1952 | Germany . |
| 2 425 697 | 12/1974 | Germany . |
| 37 09 008 C1 | 2/1988 | Germany . |
| 37 17 165 C1 | 3/1988 | Germany . |
| 196 09 291 A1 | 2/1997 | Germany . |
| 63084704 | 4/1988 | Japan . |
| 343725 | 7/1972 | U.S.S.R. . |
| 778834 | 11/1980 | U.S.S.R. . |
| 863025 | 9/1981 | U.S.S.R. . |

*Primary Examiner*—Joseph J. Hail, III
*Assistant Examiner*—Rodney Butler
*Attorney, Agent, or Firm*—Cohen, Pontani, Lieberman & Pavane

[57] ABSTRACT

A method and apparatus for continuously feeding rolling stock through a cold pilger rolling mill. A rolling stock—either a continuous or so-called "endless" piece, or a plurality of serially fed, spaced-apart pieces—is initially fed into a roll stand by a feed side drive or transporting arrangement, and thereafter, drawn through the rolling mill by a delivery side drive or transporting arrangement that is located in a rolling direction, i.e. downstream, from the feed side drive arrangement. Once the leading free end of the rolling stock is grasped by the delivery side transporting arrangement, the feed side transporting arrangement ceases to feed the rolling stock through the rolling mill, i.e. forward feeding of the rolling stock is exclusively controlled by the delivery side transporting arrangement. Thus, the critical compressive stresses and/or buckling stresses typically experienced by the rolling stock as a result of pushing the stock through the rolling mill are prevented and the disruptions in the rolling process caused by these stresses are accordingly also prevented. The transporting arrangements are operable independent of each other and at transporting or rolling speeds dependent upon each other.

14 Claims, 2 Drawing Sheets

METHOD AND APPARATUS FOR COLD ROLLING TUBES

BACKGROUND OF THE INVENTION

1. Field of the Invention

The present invention is directed to a method and apparatus for forming tubes and, more particularly, to a method and apparatus for cold rolling small diameter, thin-walled tubes on a cold pilger rolling mill.

2. Description of the Related Art

Cold pilger rolling mills having a reciprocating roll stand typically require transporting arrangements for rotating the rolling stock, i.e. the tube, pipe or rod blank, in every roll stand by a defined angle and for advancing the rolling stock by a defined distance in the rolling direction. The forward-feed movement of the rolling stock is generally carried out by means of carriages which are moved in the longitudinal axial direction of the rolling stock and which either push the stock from behind or clamp it externally. In the latter case, the clamping device is provided with a rotary drive which rotates the rolling stock along its longitudinal axis simultaneously with the advancing movement.

In other cold pilger rolling mill constructions, the rotation and forward-feed of the rolling stock are effected by means of a stationary rotary forward-feed head having circulating chains, wherein the chain links surround the stock and transport it in the rolling direction by means of friction. The rotary forward-feed head is rotationally driven by means of a planetary gear set and accordingly causes the rolling stock to rotate simultaneously as it is moved in the rolling direction.

In most cases, it is necessary to rotate and advance the rolling stock only in those time phases when the rolling stock is released by the rolls of the roll stands, i.e when the stock is positioned in a dead center region of the roll stands. In general, this means that the forward feed and rotating movements are carried out in a stop-and-go or halting manner. Since the accelerating processes take place in the millisecond range, strict requirements are set for the driving mechanisms.

In known cold pilger rolling mills, the rolling stock is advanced exclusively by the forward-feed devices or transporting arrangements located on the feed side of the rolling mill, i.e. the rolling stock is pushed through the rolling mill. Such forward-feed transporting arrangements subject the rolling stock to compressive forces and stresses acting between the forward-feed apparatus and the shaping zone of the roll stand. As a consequence, there is a risk that the rolling stock and mandrel bar will kink or buckle especially when the joint or interstice between two successive pieces of rolling stock is located between the forward-feed transporting arrangement and the end, i.e entrance point, of the shaping zone. With thin-walled or small diameter pieces of rolling stock, a commonly observed problem is that the ends of adjacent pieces of stock become wedged into one another due to the pressure load or the ends of the rolling stock are rolled into one another in the shaping zone.

SUMMARY OF THE INVENTION

The present invention provides a novel method and apparatus that continuously feeds rolling stock, i.e. tubes, pipes or rods, through a cold pilger rolling mill and overcomes the abovementioned shortcomings of the prior art. In accordance with the present invention, a rolling stock—either a continuous or so-called "endless" piece, or a plurality of serially fed, spaced-apart pieces—is initially fed into a roll stand by a feed side drive or transporting arrangement, and thereafter, drawn through the rolling mill by a delivery side drive or transporting arrangement. Once the leading free end of the rolling stock is grasped by the delivery side transporting arrangement, the feed side transporting arrangement ceases to feed the rolling stock through the rolling mill, i.e. forward feeding of the rolling stock is exclusively controlled by the delivery side transporting arrangement. Thus, the critical compressive stresses and/or buckling stresses typically experienced by the rolling stock as a result of pushing the stock through the rolling mill are prevented and the disruptions in the rolling process caused by these stresses are accordingly also prevented.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

DETAILED DESCRIPTION OF THE PRESENTLY PREFERRED EMBODIMENTS

The present invention provides a novel method and apparatus that continuously feeds rolling stock, i.e. tubes, pipes or rods, through a cold pilger rolling mill and overcomes the abovementioned shortcomings of the prior art. In accordance with the present invention, a rolling stock—either a continuous or so-called "endless" piece, or a plurality of serially fed, spaced-apart pieces—is initially fed into a roll stand by a feed side drive or transporting arrangement, and thereafter, drawn through the rolling mill by a delivery side drive or transporting arrangement. Once the leading free end of the rolling stock is grasped by the delivery side transporting arrangement, the feed side transporting arrangement ceases to feed the rolling stock through the rolling mill, i.e. forward feeding of the rolling stock is exclusively controlled by the delivery side transporting arrangement. Thus, the critical compressive stresses and/or buckling stresses typically experienced by the rolling stock as a result of pushing the stock through the rolling mill are prevented and the disruptions in the rolling process caused by these stresses are accordingly also prevented.

Figure 1:
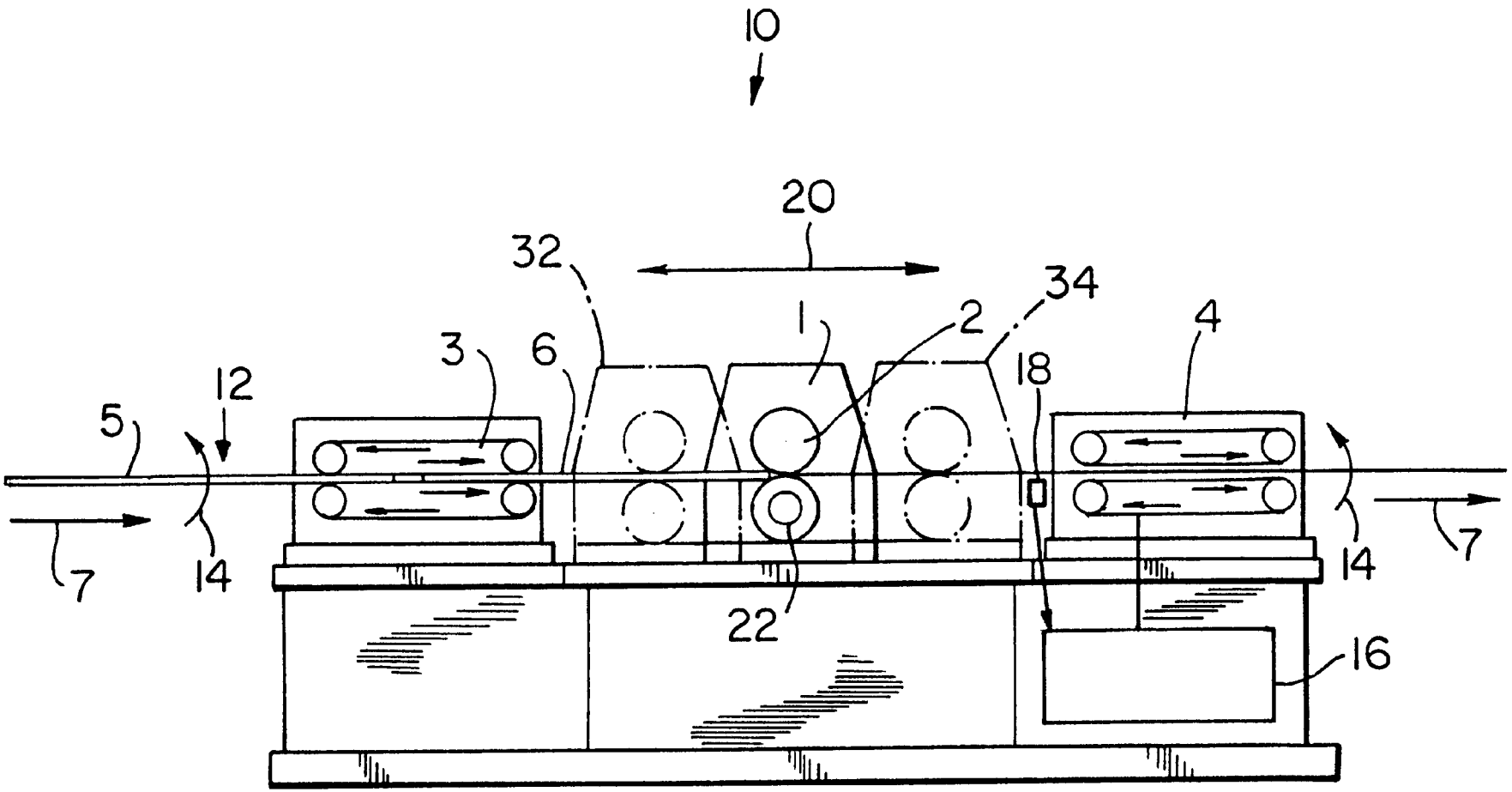
FIG. 1 depicts a cold pilger rolling mill having a reciprocating roll stand and feed side and delivery side transporting arrangements configured in accordance with the present invention.

Referring now to the drawing, FIG. 1 depicts a cold pilger rolling mill 10 having a feed side drive or transporting arrangement 3, a delivery side drive or transporting arrangement 4, and an oscillating or reciprocating roll stand 1 located therebetween and having a roll pair 2. Each roll of the roll pair 2 includes a reduced diameter portion that together define a shaping zone in the roll stand 1. The shaping zone is defined such that the rolling stock 12 is released from the roll pair 2 when the roll stand 1 is positioned in each of two dead center positions 32, 34 (as described in further detail hereinbelow).

A rolling stock 12 is fed through the mill 10 in a rolling direction 7 by a combination of pushing by the feed side drive arrangement 3 and pulling by the delivery side drive arrangement 4. The rolling stock 12 may comprise a plurality of serially arranged, spaced apart blanks 5, 6, or alternatively, it may comprises a substantially continuous or so-called "endless" piece. As the rolling stock 12 is processed by the rolling mill 10 it is caused to rotate in a direction indicated by arrow 14 by the feed side and delivery side drive arrangements 3, 4.

The roll stand 1 is reciprocally movable between a feed side dead center position 32 and a delivery side dead center position 34 (indicated by the phantom lines) in which the rolling stock 12 is released from the rolling stand 1. The reciprocal or oscillating movement of the stand 1, indicated by arrow 20, is generated by a crank mechanism (not shown) situated below the roll stand 1. The roll pair 2 is driven by pinions 22 located on the roll pair axes which engage stationary toothed racks (not shown) so as to rotate the roll pair 2 synchronously with the movement of the roll stand 1.

In a preferred embodiment of the present invention, the feed side drive arrangement 3 is located on an input or feed side of the rolling mill 10 and functions in cooperation with the delivery side drive arrangement 4 located on an output or delivery side of the rolling mill 10. The cooperation between the drive arrangements 3, 4 is such that they alternately feed the rolling stock 12 through the mill 10 and are operable at independent yet related rolling or transporting speeds.

The delivery side drive arrangement 4 is preferably constructed as a stationary rotary forward-feed head with circulating chains having chain links that frictionally surround the rolling stock 12 and transport it in the rolling direction 7. Such devices are generally known since they have been previously used on the feed side of a rolling mill, i.e. upstream or in front of the roll stand, as rotary forward-feed driving means and can replace the feeding clamping chuck of conventional cold pilger rolling mills.

In accordance with the present invention, and with appropriate coordination between the drive arrangements 3, 4, the rolling stock 12 can first be guided and initially rotated by the feed side drive arrangement 3 into the roll stand 1. Once the free end of the rolling stock 12 reaches the delivery side drive arrangement 4 and is circumferentially grasped thereby, the feed side drive arrangement 3 can be switched in such a way that the delivery side drive arrangement 4 exclusively draws the rolling stock 12 in the rolling direction 7. In other words, the rolling stock 12 is pushed through the rolling mill 10 until the free end of the rolling stock 12 is grasped by the delivery side drive arrangement 4, at which point the rolling stock 12 is pulled through the rolling mill 10 under the sole control of the delivery side drive arrangement 4.

The delivery side drive arrangement 4 is preferably operated at a transporting speed which is slightly higher than the speed at which the rolling stock 12 exits the roll stand 1 thus exerting a constant tractive force on the rolling stock 12 so that the critical compressive stresses and/or buckling stresses typically introduced in the rolling stock 12 are reliably prevented. Further, the deformation or shaping capability of the rolling stock 12 can be enhanced by externally applied tensile stress, which occurs in the present invention.

The feed side drive arrangement 3 can be switched on and off independent from the delivery side drive arrangement 4, so that the various states, e.g. initial feed of the rolling stock 12, forming of the rolling stock 12, and final feed of the rolling stock 12, during rolling can be detected. Thus, during the initial feed or rolling of the rolling stock 12, it is only necessary to operate the feed side drive arrangement 3. As soon as the rolling stock 12 has exited from the roll stand 1 and has been introduced into the delivery side drive arrangement 4, forward feed of the rolling stock 12 in the rolling direction 7 is controlled by the delivery side drive arrangement 4 and the feed side drive arrangement 3 can be switched off. In other operating states, it is possible to switch on the feed side drive arrangement 3 and delivery side drive arrangement 4 jointly. When operating thusly, each of the drive arrangements 3, 4 is operable at its own transporting speed. In order to achieve the desired coordination between the two drive arrangements 3, 4, a measuring means 18 initially measures the speed of the rolling stock 12 at the delivery side of the rolling mill 10 behind or downstream of the roll stand 1 while the delivery side drive arrangement 4 is open, i.e. when forward movement of the rolling stock 12 is controlled by the feed side drive arrangement 3, and communicates the resulting measurements to a speed regulating means 16 of the delivery side drive arrangement 4. Consequently, the speed of the delivery side drive arrangement 4 is increased relative to the transporting speed of the feed side drive arrangement 3 by approximately 3% to 10% before the delivery side drive arrangement 4 is closed about the rolling stock 12 and takes control of the forward movement thereof.

This procedure ensures that the correct transporting speed of the delivery side drive arrangement 4 is adjusted, which must take into account the fact that the rolling stock 12, due to the deformation in the shaping zone, is given a longitudinal transporting speed which depends on the shaping process itself. This transporting speed may then be increased in the above-described manner to prevent compressive stresses and/or buckling stresses.

As the rolling stock 12 is moved through the rolling mill 10 under the control of the delivery side drive arrangement 4, the extension or stretching of the rolling stock 12 that occurs during forming thereof must be taken into account. Specifically, when the rolling stock 12 comprises a plurality of blanks 5, 6, i.e. a leading blank 6 and a following blank 5, the following blank 5 is inserted into the feed side drive arrangement 3 at a distance of approximately 20 mm behind the trailing end of the leading blank 6 so that the adjacent free ends of successive blanks 5, 6 do not contact one another, not even in the reduced area. As soon as the leading end of the leading blank 6 has reached the shaping zone in the roll stand 1, the leading blank 6 is quickly pulled out of the roll stand 1 as a result of the increased transporting speed of the delivery side drive arrangement 4 so that no contact can take place with the leading end of the following blank 5.

Clamping chucks typically required to assist with the forward movement of the rolling stock 12 through the mill 10 can be dispensed with on both the feed side and delivery side of the rolling mill 10 when using identical rotary forward-feed heads arranged in front of and behind the roll stand 1, respectively. The advantages of the invention can be realized in a particularly favorable manner by driving means of this type.

A method of threading a rolling stock 12 into a cold pilger rolling mill 10 in accordance with the present invention includes reducing the outer diameter of the tip or leading end of the rolling stock 12 to approximately the same diameter as the finished diameter of the pilger rolled rolling stock. This reduced diameter end is pushed through the roll stand 1 by the feed side drive arrangement 3 into the delivery side drive arrangement 4, proceeding from the feed side. A threading-in method of this type is required when using a single delivery side drive arrangement 4 configured in accordance with the present invention. This is especially true when very long or so-called "endless" rolling stock 12 is to be rolled. In this case, the rolling stock 12 need only be introduced once into the delivery side drive arrangement 4 and can then be advanced virtually endlessly and thus "drawn" through the shaping zone of the roll stand 1.

Figure 2:
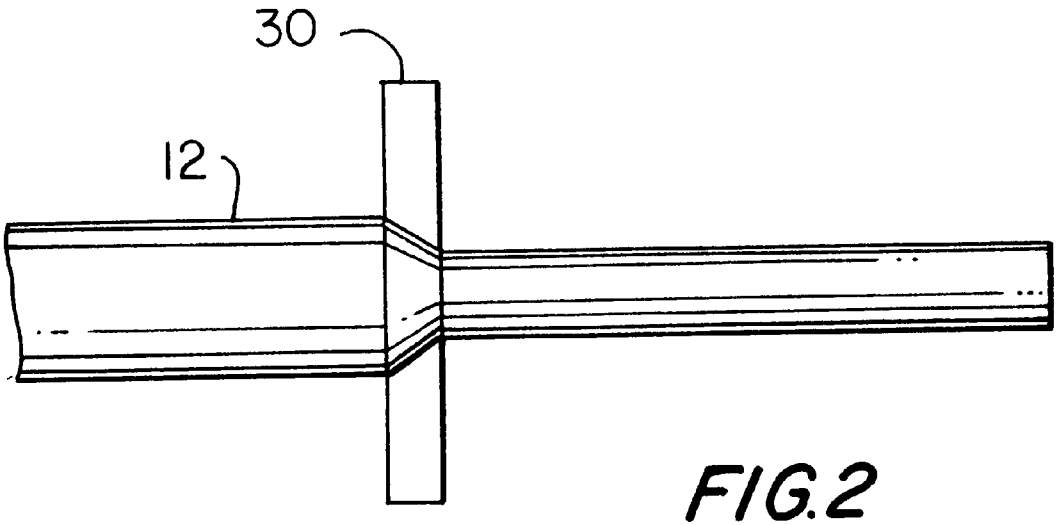
FIG. 2 depicts a drawing device for reducing the leading end of the rolling stock to be run through the mill of FIG. 1.

The diametrical reduction of the leading end or tip of the rolling stock 12 can be produced, for example, by drawing the leading end of the rolling stock 12 into a drawing device 30 (see FIG. 2) or by other art recognized reduction methods and techniques including devices known for forming drawing angles or drawing points in front of drawing machines.

Figure 3:
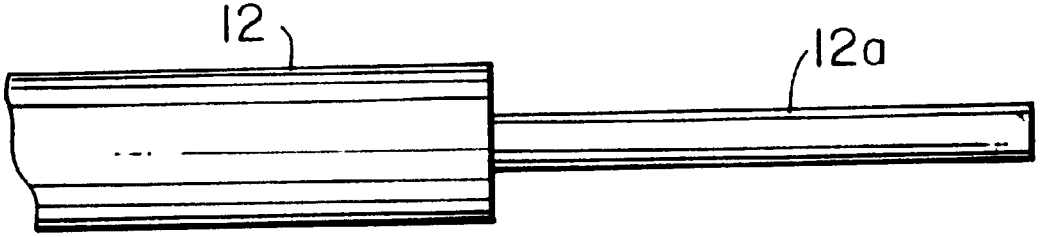
FIG. 3 depicts a rolling stock having a reduced diameter rod coaxially affixed to a leading end of the rolling stock.

Alternatively, FIG. 3 shows that the reduced diameter portion of the rolling stock 12 may also be formed by coaxially affixing a rod 12*a* having the desired diameter to the leading end or tip of the rolling stock 12.

The present invention can advantageously ensure that the ends of the rolling stock 12 do not become wedged and are not rolled into one another when a plurality of blanks 5, 6 are introduced immediately one behind the other. This is because the features of the present invention ensure that a slight distance, preferably of approximately 20 mm, is always maintained between successive blanks at the interstice of the two blanks.

Thus, the present invention provides a method and apparatus for cold pilger rolling very thin-walled pipes, tubes, or rods having a wall thickness-to-diameter ratio of less than approximately 1:40, which was previously possible, if at all, only with difficulty. The present invention increases process safety of the cold pilger rolling process and prevents processing interruptions. The rolling of shorter lengths of pipe or tube can also be improved according to the present invention. The invention can be applied equally well for pipes or tubes or for wires having small profiles.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve substantially the same results are within the scope of the invention. It is the intention, therefore, to be limited only as indicated by the scope of the claims appended hereto.

What is claimed is:

1. An apparatus for forming a thin-walled rolling stock in a cold pilger rolling mill having a feed side and a delivery side, the rolling stock being movable through the rolling mill in a rolling direction defined from the feed side to the delivery side, said apparatus comprising:

a reciprocating roll stand located between the feed side and the delivery side and having two rolls each having a reduced diameter portion defined circumferentially thereabout, said reduced diameter portions together defining a shaping zone in said reciprocating roll through which the rolling stock passes as the rolling stock is moved in the rolling direction and by which the rolling stock is formed as the rolling stock passes therethrough, said roll stand being reciprocally movable between first and second dead center positions, the rolling stock being rotated within said roll stand when said roll stand is positioned at at least one of said first and said second dead center positions and exiting said roll stand at a second predetermined rolling speed;

a delivery side transporting arrangement located at the delivery side of the rolling mill and in the rolling direction from said roll stand and having a speed regulating means, said delivery side transporting arrangement circumferentially grasping the rolling stock as it exits said roll stand for rotating and moving the rolling stock through the rolling mill in the rolling direction at a first predetermined rolling speed;

a feed side transporting arrangement located at the feed side of the rolling mill, said feed side transporting arrangement periodically rotating and moving the rolling stock through the mill in the rolling direction, the movement of the rolling stock by said feed side transporting arrangement being dependent upon said delivery side transporting arrangement;

means for measuring the second predetermined rolling speed as the rolling stock exits the roll stand and before the rolling stock is grasped by the delivery side transporting arrangement and generating an output; and means for increasing the first predetermined rolling speed in response to said output of said means for measuring said second predetermined rolling speed.

2. The apparatus of claim 1, wherein said feed side transporting arrangement is operable independent of said delivery side transporting arrangement.

3. The apparatus of claim 1, wherein said delivery side transporting arrangement comprises a stationary rotary forward-feed head having circulating chains comprised of chain links, said chain links frictionally surrounding the rolling stock to move the rolling stock in the rolling direction.

4. The apparatus of claim 1, wherein said increased first predetermined speed is operative for preventing buckling stresses between successive ones of said rolling stock.

5. A method of forming a rolling stock in a cold pilger rolling mill having a feed side and a delivery side, the rolling stock having a leading end defining a starting diameter, the rolling mill having a feed side transporting arrangement operable at a first predetermined rolling speed and having a speed regulating means, a delivery side transporting arrangement operable at a second predetermined rolling speed, and a reciprocating roll stand located therebetween, the rolling stock being movable through the rolling mill in a rolling direction defined from the feed side to the delivery side and being formable by the roll stand to a finished diameter, said method comprising the steps of:

(a) reducing the diameter of the leading end of the rolling stock to approximately the finished diameter of the rolling stock; and (b) pushing the reduced diameter leading end of the rolling stock through the roll stand into the delivery side transporting arrangement proceeding from the feed side of the rolling mill;

(c) measuring the second predetermined rolling speed as the rolling stock exits the roll stand and before the rolling stock is grasped by the delivery side transporting arrangement;

(d) communicating said measured second predetermined rolling speed to the speed regulating means of the delivery side drive arrangement; and (e) increasing the first predetermined rolling speed so that said first predetermined rolling speed prevents buckling stresses between successive ones of the rolling stock.

6. The method of claim 5, wherein said step (a) further comprises drawing the leading end of the rolling stock into a drawing device.

7. The method of claim 5, wherein said step (a) further comprises coaxially affixing a rod having a diameter approximately equal to the finished diameter of the rolling stock to the leading end of the rolling stock.

8. An apparatus for forming a thin-walled rolling stock in a cold pilger rolling mill having a feed side and a delivery side, the rolling stock being movable through the rolling mill in a rolling direction defined from the feed side to the delivery side, said apparatus comprising:

a reciprocating roll stand located between the feed side and the delivery side and having two rolls each having a reduced diameter portion defined circumferentially thereabout, said reduced diameter portions together defining a shaping zone in said reciprocating roll through which the rolling stock passes as the rolling stock is moved in the rolling direction and by which the rolling stock is formed as the rolling stock passes therethrough, said roll stand being reciprocally movable between first and second dead center positions, the rolling stock being rotated within said roll stand when said roll stand is positioned at at least one of said first and said second dead center positions; and a delivery side transporting arrangement located at the delivery side of the rolling mill and in the rolling direction from said roll stand, said delivery side transporting arrangement circumferentially grasping the rolling stock as it exits said roll stand for rotating and moving the rolling stock through the rolling mill in the rolling direction at a first predetermined rolling speed, wherein said first predetermined rolling speed is operative for preventing buckling stresses between successive ones of said rolling stock.

9. The apparatus of claim 8, further comprising a feed side transporting arrangement located at the feed side of the rolling mill, said feed side transporting arrangement periodically rotating and moving the rolling stock through the mill in the rolling direction, the movement of the rolling stock by said feed side transporting arrangement being dependent upon said delivery side transporting arrangement.

10. The apparatus of claim 8, wherein said delivery side transporting arrangement comprises a stationary rotary forward-feed head having circulating chains comprised of chain links, said chain links frictionally surrounding the rolling stock to move the rolling stock in the rolling direction.

11. The apparatus of claim 9, wherein the rolling stock exits said roll stand at a second predetermined rolling speed and wherein said first predetermined rolling speed is greater than said second predetermined rolling speed.

12. The apparatus of claim 9, wherein said feed side transporting arrangement is operable independent of said delivery side transporting arrangement.

13. A method of forming a rolling stock in a cold pilger rolling mill having a feed side and a delivery side, the rolling mill having a delivery side transporting arrangement operable at a first predetermined rolling speed and having a speed regulating means, a feed side transporting arrangement operable at a second predetermined rolling speed, and a reciprocating roll stand located therebetween, the rolling stock being graspable by and movable through the rolling mill by the feed side and delivery side drive arrangements in a rolling direction defined from the feed side to the drive side and being formable by the roll stand to a finished diameter, said method comprising the steps of:

(a) measuring the second predetermined rolling speed as the rolling stock exits the roll stand and before the rolling stock is grasped by the delivery side transporting arrangement;

(b) communicating said measured second predetermined rolling speed to the speed regulating means of the delivery side drive arrangement; and (c) increasing the first predetermined rolling speed so that said first predetermined rolling speed prevents buckling stresses between successive ones of the rolling stock.

14. The method of claim 13, wherein said step (c) further comprises increasing the first predetermined rolling speed between approximately 3% and 10% before the rolling stock is grasped by the delivery side transporting arrangement.

* * * * *